US012696982B2

(12) United States Patent
Xiao

(10) Patent No.: US 12,696,982 B2
(45) Date of Patent: Aug. 4, 2026

(54) LATE-MODEL COMPRESSIBLE FURNITURE

(71) Applicant: Guangzhou Aiya Network Technology Co., Ltd., Guangzhou (CN)

(72) Inventor: Lei Xiao, Guangzhou (CN)

( * ) Notice: Subject to any disclaimer, the term of this patent is extended or adjusted under 35 U.S.C. 154(b) by 266 days.

(21) Appl. No.: 18/390,983

(22) Filed: Dec. 20, 2023

(65) Prior Publication Data

US 2024/0415292 A1 Dec. 19, 2024

(30) Foreign Application Priority Data

Jun. 16, 2023 (CN) ..... 202321557648.X

(51) Int. Cl.

| | |
|---|---|
| ***A47C 17/86*** | (2006.01) |
| ***A47C 21/04*** | (2006.01) |
| ***A47C 27/06*** | (2006.01) |
| ***A47C 27/15*** | (2006.01) |

(52) U.S. Cl.

CPC ..... *A47C 17/86* (2013.01); *A47C 21/048* (2013.01); *A47C 27/067* (2013.01); *A47C 27/15* (2013.01)

(58) Field of Classification Search

CPC ..... A47C 7/748; A47C 17/86; A47C 21/048; A47C 27/067; A47C 27/15; A47C 31/11

USPC ..... 297/219.1, 180.12, 180.11

See application file for complete search history.

(56) References Cited

U.S. PATENT DOCUMENTS 2,010,728 A * 8/1935 Kleiner ..... A47C 27/067 5/200.1
4,292,701 A * 10/1981 Woychick ..... A47C 27/085 5/915
5,002,336 A * 3/1991 Feher ..... A47C 7/744 5/655.5
5,430,900 A * 7/1995 Kim ..... A61N 5/06 5/737
5,516,189 A * 5/1996 Ligeras ..... B60N 2/5685 219/202
6,179,378 B1 * 1/2001 Baumgartner ..... B60N 2/5685 297/180.12
6,541,737 B1 * 4/2003 Eksin ..... B60N 2/5635 219/217
7,695,062 B2 * 4/2010 Stowe ..... B60N 2/5621 5/724
7,942,477 B1 * 5/2011 Toba ..... B60N 2/003 297/180.12

(Continued)

FOREIGN PATENT DOCUMENTS

KR 20130096014 A * 8/2013 ..... A47C 27/064

*Primary Examiner* — Jose V Chen

(57) ABSTRACT

The present invention has disclosed late-model compressible furniture in the technical field of furniture and sofas, which comprises a sofa cover, a foam layer and a spring assembly, wherein the foam layer is sleeved inside the sofa cover, the spring assembly is sleeved inside the foam layer, the spring assembly comprises a spring-fixing bag, and a spring means fixedly connected inside the spring-fixing bag. In the device, the foam layer and the spring assembly are configured in their entirety, so that before transportation a spring compressor is used to compress the sofa in its entirety, providing convenience for transportation and avoiding inconvenient transportation due to excessive volume, after transportation to the designated location, the compressed package opens to enable the spring means disposed inside it to quickly return to a full shape.

5 Claims, 3 Drawing Sheets

(56) References Cited

U.S. PATENT DOCUMENTS 10,201,039 B2 * 2/2019 Barfuss ..... H01C 17/0652
12,285,111 B1 * 4/2025 Haines ..... A47C 31/123
2002/0166174 A1 * 11/2002 Bullard ..... A47C 27/053 5/655.7
2005/0193497 A1 * 9/2005 Baker ..... A47C 27/001 5/721
2006/0191886 A1 * 8/2006 Pak, II ..... A47C 21/048 219/217
2007/0040424 A1 * 2/2007 Neustat ..... A47C 7/72 297/219.1
2009/0078690 A1 * 3/2009 Lee ..... H05B 3/12 219/217
2009/0295199 A1 * 12/2009 Kincaid ..... B60N 2/0035 297/180.12
2010/0109390 A1 * 5/2010 Nishimura ..... B60N 2/0033 297/180.12
2010/0235991 A1 * 9/2010 Ward ..... A47C 21/044 165/61
2011/0121618 A1 * 5/2011 Fischer ..... B60R 21/01532 297/180.12
2012/0110734 A1 * 5/2012 An ..... A47C 21/048 5/423
2012/0273475 A1 * 11/2012 An ..... H05B 3/34 219/508
2012/0311784 A1 * 12/2012 Yoon ..... A47C 21/048 5/423
2013/0091634 A1 * 4/2013 Shearon ..... A47C 27/15 5/693
2013/0134745 A1 * 5/2013 Aoki ..... B60N 2/0034 297/180.12
2014/0125098 A1 * 5/2014 Vainberg ..... A47C 31/11 297/219.1
2014/0191544 A1 * 7/2014 Comber, V ..... A47D 1/103 297/219.1
2014/0325763 A1 * 11/2014 Mason ..... B29C 44/06 264/154
2015/0054317 A1 * 2/2015 Fortune ..... B60N 2/5685 297/180.12
2015/0208815 A1 * 7/2015 Chandler ..... A47C 7/748 5/421
2015/0230622 A1 * 8/2015 Orbelian ..... A47C 31/007 43/132.1
2015/0232006 A1 * 8/2015 Yu ..... B60N 2/5685 297/180.12
2015/0239379 A1 * 8/2015 Yoshida ..... A47C 7/748 297/180.12
2015/0285431 A1 * 10/2015 Slusher, II ..... A47C 23/16 267/86
2015/0289667 A1 * 10/2015 Oakhill ..... A47C 27/18 5/423
2015/0335163 A1 * 11/2015 Kilgore ..... A47C 27/06 5/718
2016/0052432 A1 * 2/2016 Lafferty ..... B60N 2/5685 297/180.12
2016/0220029 A1 * 8/2016 Caron ..... A47C 17/86
2017/0348182 A1 * 12/2017 Yoo ..... A47C 31/008
2019/0008287 A1 * 1/2019 Bolonhese ..... A61H 1/005
2019/0320810 A1 * 10/2019 Choi ..... A47C 27/148
2020/0170418 A1 * 6/2020 Oh ..... A47C 31/007
2021/0387440 A1 * 12/2021 Lee ..... B32B 7/12
2022/0031085 A1 * 2/2022 Sheikh ..... A47C 27/144
2022/0369827 A1 * 11/2022 Rose ..... A47C 27/062
2024/0023721 A1 * 1/2024 Tar ..... A47C 21/044
2024/0023722 A1 * 1/2024 Park ..... F04D 29/56

* cited by examiner

LATE-MODEL COMPRESSIBLE FURNITURE

FIELD OF THE INVENTION

The present invention relates to the technical field of furniture and sofas, specifically relates to late-model compressible furniture.

BACKGROUND OF THE INVENTION

With the improvement of people's living standards and housing conditions, the sitting room within the living room is getting bigger and bigger, whereupon the sofa that decorates the sitting room is also getting bigger, and common sofas are mostly made of wood or steel, which are used as a support in their entirety, then filled with sponge and other filling, therefore, their volume is unvaried due to the overall limitation of the support.

As the overall volume of the support of the existing sofas is too large, it is inconvenient to load and transport in long-distance transportation, therefore certain limitations occur in use.

SUMMARY OF THE INVENTION

The objective of the present invention is to provide late-model compressible furniture, so as to solve the problem mentioned in the background that the overall volume of the support of the existing sofas is too large, resulting in inconvenience to load and transport in long-distance transportation, therefore occurrence of certain limitations in use.

In order to achieve the above objective, the present invention provides the following technical solutions: late-model compressible furniture includes a sofa cover, a foam layer and a spring assembly, wherein the foam layer is sleeved inside the sofa cover, the spring assembly is sleeved inside the foam layer, the spring assembly includes a spring-fixing bag, and a spring means fixedly connected inside the spring-fixing bag.

Preferably, the spring means includes a first spring, a second spring and a fixing plate, the first spring is an hourglass-type spring having small circles in the middle and large circles at both ends.

Preferably, the first spring is several in number, the first spring articulates with a second spring in the horizontal direction for fixed connection, and one end of the second spring is fixedly connected with the fixing plate.

Preferably, a fixed zipper is fixed on one side of the sofa cover, a heating pad is attached on the upper end of the sofa cover, and a thermal insulation layer is disposed between the sofa cover and the foam layer.

Preferably, a control switch is fixedly connected on one side of the upper surface of the heating pad, and attaching pieces are fixedly connected at the four corners of the other side of the heating pad.

Preferably, a heating sheet is fixedly connected inside the heating pad, the heating sheet is several in number, a battery is fixedly connected on one side inside the heating pad, and the battery is electrically connected to the heating sheet through a wire.

Compared with the prior art, the present invention has the following beneficial effects.

1. The foam layer and the spring assembly are configured in their entirety, so that before transportation a spring compressor is used to compress the sofa in its entirety, providing convenience for transportation and avoiding inconvenient transportation due to excessive volume, after transportation to the designated location, the compressed package opens to enable the spring means disposed inside it to quickly return to a full shape.
2. The independent first springs articulate with the second springs in their entirety, avoiding the independent first springs from easing deformation after long-term use, the second springs are configured to make the articulation joints as a whole, which also have elasticity, respectively, and facilitate the overall compression.
3. The heating pad is configured to heat the sofa in winter, so that in winter, the sofa is rapidly heated providing better experience to users, therefore the users are willing to use the sofa even in cold weather, the thermal insulation layer is configured to function as certain heat insulation on the bottom and avoid damage to the foam layer.

Wherein, 1—sofa cover; 2—fixed zipper; 3—foam layer; 4—spring assembly; 5—spring-fixing bag; 6—spring means; 7—first spring; 8—second spring; 9—fixing plate; 10—thermal insulation layer; 11—heating pad; 12—control switch; 14—attaching piece; 15—heating sheet; 16—battery.

DETAILED DESCRIPTION OF SOME EMBODIMENTS

We shall make a clear and complete description on the technical solution in the embodiment of the present invention in combination with the drawings in the embodiment of the present invention, but the described technical solution is obviously only a part of the embodiment of the present invention, not all embodiments. Based on the embodiments in the present invention, all other embodiments obtained by a person skilled in the art without doing creative work fall within the protection scope of the present invention.

Figure 1:
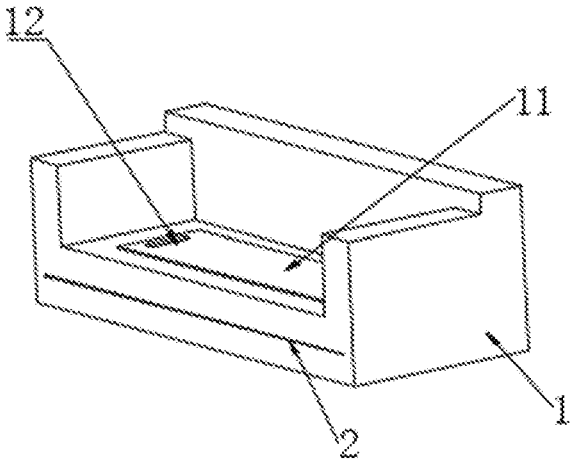
FIG. 1 is a structure diagram of the present invention.
Figure 2:
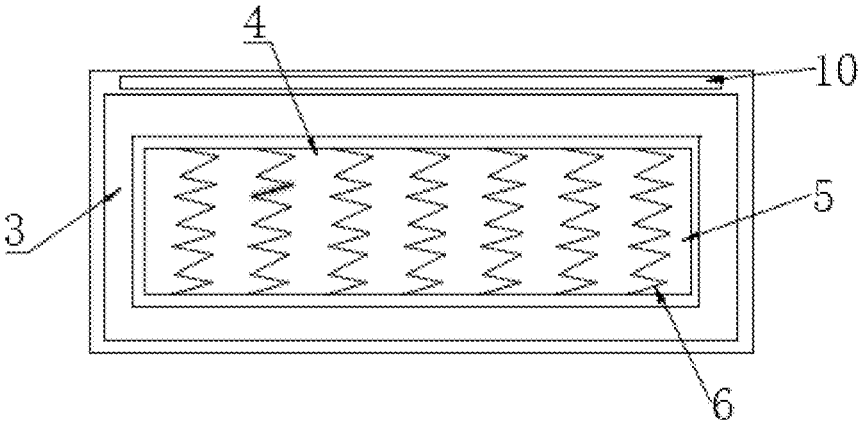
FIG. 2 is a schematic diagram of the internal structure of the sofa cover of the present invention.
Figure 3:
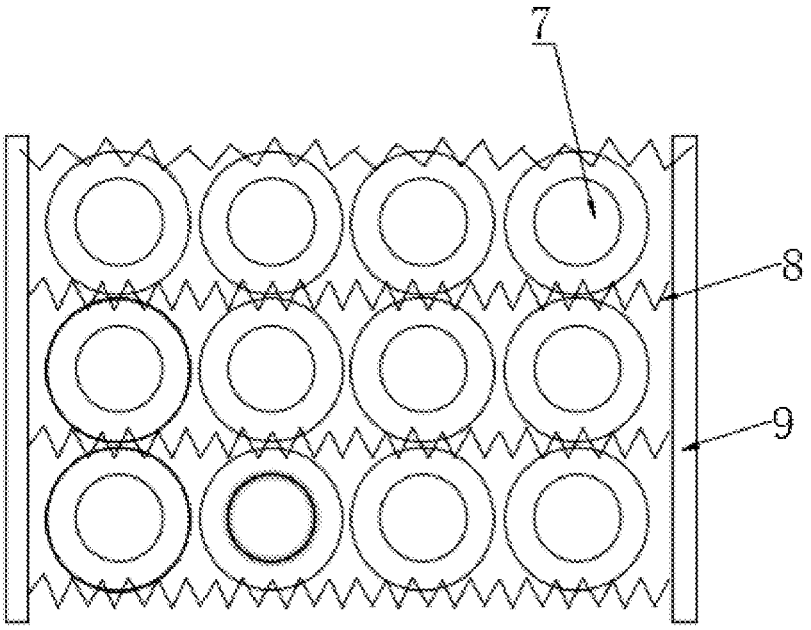
FIG. 3 is a structure diagram of the spring means of the present invention.
Figure 4:
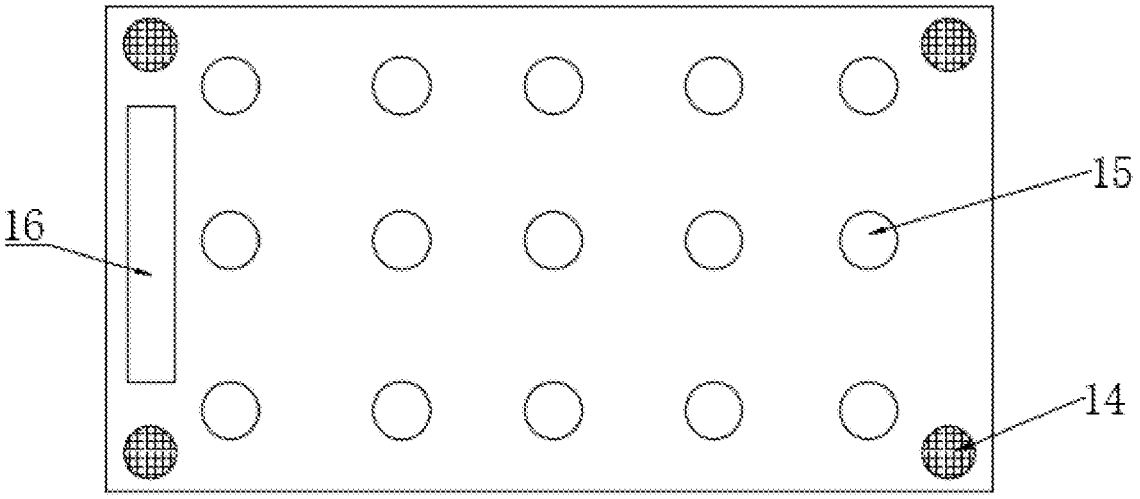
FIG. 4 is a structure diagram of the heating pad of the present invention.
Figure 5:
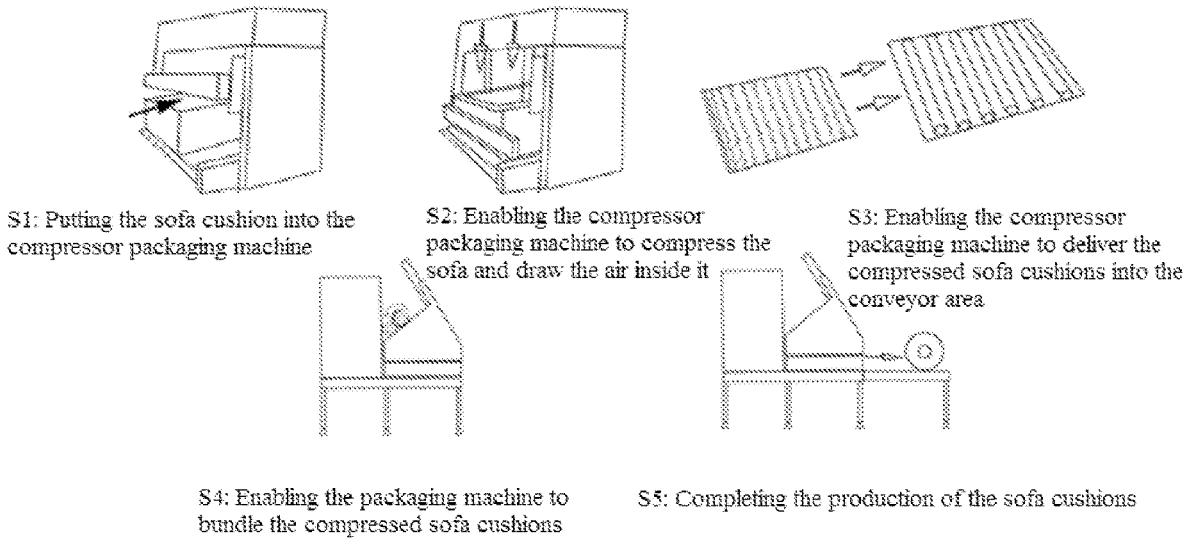
FIG. 5 is the compression process diagram of the sofa cushion of the present invention.

As shown in FIGS. 1-4, the present invention provides the following technical solutions: late-model compressible furniture includes the sofa cover 1, the foam layer 3 and the spring assembly 4, wherein the foam layer 3 is sleeved inside the sofa cover 1, the spring assembly 4 is sleeved inside the foam layer 3, the spring assembly 4 includes the spring-fixing bag 5, and the spring means 6, which is fixedly connected inside the spring-fixing bag.

In this embodiment, the foam layer 3 and the spring assembly 4 are configured in their entirety, so that before transportation a spring compressor is used to compress the sofa in its entirety, providing convenience for transportation and avoiding inconvenient transportation due to excessive volume, after transportation to the designated location, the compressed package opens to enable the spring means 6 disposed inside it to quickly return to a full shape.

Specifically, the spring means 6 includes the first spring 7, the second spring 8 and the fixing plate 9, the first spring 7 is an hourglass-type spring having small circles in the middle and large circles at both ends.

In this embodiment, the first spring 7 is configured to enable the overall structure to have better elasticity and to be more comfortable.

Specifically, the first spring 7 is several in number, the first spring 7 articulates with the second spring 8 in the horizontal direction for fixed connection, and one end of the second spring 8 is fixedly connected with the fixing plate.

In this embodiment, the independent first springs 7 articulate with the second springs 8 in their entirety, avoiding the independent first springs 7 from easing deformation after long-term use, the second springs 8 are configured to make the articulation joints as a whole, which also have elasticity, respectively, and facilitate the overall compression.

Specifically, the fixed zipper 2 is fixed on one side of the sofa cover 1, the heating pad 11 is attached on the upper end of the sofa cover 1, and the thermal insulation layer 10 is disposed between the sofa cover 1 and the foam layer 3.

In this embodiment, the fixed zipper 2 is configured to facilitate the replacement of the foam layer 3 inside the sofa; the heating pad 11 is configured to heat the sofa in winter, so that in winter, the sofa is rapidly heated providing better experience to users, therefore the users are willing to use the sofa even in cold weather, the thermal insulation layer 10 is configured to function as certain heat insulation on the bottom and avoid damage to the foam layer 3.

Specifically, the control switch 12 is fixedly connected on one side of the upper surface of the heating pad 11, and the attaching pieces 14 are fixedly connected at the four corners of the other side of the heating pad 11.

In this embodiment, the control switch 12 is configured to facilitate control of temperature and switching; the attaching pieces 14 are configured to facilitate detachment and installation of the heating pad 11.

Specifically, the heating sheet 15 is fixedly connected inside the heating pad 11, the heating sheet 15 is several in number, the battery 16 is fixedly connected on one side inside the heating pad 11, and the battery 16 is electrically connected to the heating sheet 15 through a wire.

In this embodiment, the battery 16 is configured to provide the heating sheet 15 with power, so that the heating sheet 15 may heat the heating pad 11 thereby providing suitable temperature.

Although the embodiments of the present invention have been shown and described therein, for a person skill in the art, it is understandable that a variety of changes, modifications, substitutions and variations may be made on these embodiments without departing from the principle and essence of the present invention, and the protection scope of the present invention is defined by the claims and their equivalents.

What is claimed is:

1. A late-model compressible furniture comprising a sofa cover, a foam layer and a spring assembly, wherein said foam layer is sleeved inside said sofa cover, said spring assembly is sleeved inside said foam layer, said spring assembly comprises a spring-fixing bag, and a spring means fixedly connected inside said spring-fixing bag;

wherein said spring means comprises a first spring, a second spring and a fixing plate, said fixing plate is disposed inside said spring-fixing bag and is configured to fix and support said second spring, said first spring is an hourglass-type spring having small circles in a middle and large circles at both ends.

2. The late-model compressible furniture according to claim 1, wherein said first spring is several in number, said first spring articulates with a second spring in the horizontal direction for fixed connection, and one end of said second spring is fixedly connected with said fixing plate.

3. The late-model compressible furniture according to claim 1, wherein a fixed zipper is fixed on one side of said sofa cover, a heating pad is attached on the upper end of said sofa cover, and a thermal insulation layer is disposed between said sofa cover and said foam layer.

4. The late-model compressible furniture according to claim 3, wherein a control switch is fixedly connected on one side of the upper surface of said heating pad, and attaching pieces are fixedly connected at four corners of the other side of aid heating pad.

5. The late-model compressible furniture according to claim 3, wherein a heating sheet is fixedly connected inside said heating pad, said heating sheet is several in number, a battery is fixedly connected on one side inside said heating pad, and said battery is electrically connected to said heating sheet through a wire.

* * * * *